US011788283B2

(12) United States Patent
Lee

(10) Patent No.: US 11,788,283 B2
(45) Date of Patent: Oct. 17, 2023

(54) WALL SYSTEM WITH HEIGHT ADJUSTMENT UNIT

(71) Applicant: Chung Jong Lee, Gangwon-do (KR)

(72) Inventor: Chung Jong Lee, Gangwon-do (KR)

(73) Assignee: Chung Jong Lee, Gangwon-do (KR)

( * ) Notice: Subject to any disclaimer, the term of this patent is extended or adjusted under 35 U.S.C. 154(b) by 135 days.

(21) Appl. No.: 17/617,253

(22) PCT Filed: Jun. 18, 2020

(86) PCT No.: PCT/KR2020/007937

§ 371 (c)(1),
(2) Date: Dec. 7, 2021

(87) PCT Pub. No.: WO2020/256449

PCT Pub. Date: Dec. 24, 2020

(65) Prior Publication Data

US 2022/0243464 A1 Aug. 4, 2022

(30) Foreign Application Priority Data

Jun. 20, 2019 (KR) ..... 10-2019-0073781

(51) Int. Cl.
*E04B 2/74* (2006.01)

(52) U.S. Cl.
CPC ..... *E04B 2/7453* (2013.01); *E04B 2002/749* (2013.01)

(58) Field of Classification Search
CPC .. E04B 2/7453; E04B 2002/749; E04B 2/821; E04B 2002/7492; E04B 2/7401; E04B 2/58; E04B 1/34305; E04B 1/34315; E04B 1/34384; E04B 1/38; E04B 2001/34394; E04B 2/7448
See application file for complete search history.

(56) References Cited

U.S. PATENT DOCUMENTS 4,086,734 A 5/1978 Hayashi
5,302,039 A * 4/1994 Omholt ..... E04B 2/7401 24/135 R (Continued)

FOREIGN PATENT DOCUMENTS

CN 1483102 A 3/2004
CN 200968008 Y 10/2007

(Continued)

*Primary Examiner* — Patrick J Maestri
(74) *Attorney, Agent, or Firm* — NKL LAW; Jae Youn Kim

(57) ABSTRACT

A wall system with a height adjustment unit includes: a support frame which is installed on a floor surface; a lifting and lowering frame which is coupled to the support frame so as to be able to move up and down along the outer surface of the support frame while surrounding the support frame; and a plurality of height adjustment units which are installed between the support frame and the lifting and lowering frame so as to lift or lower the lifting and lowering frame. The height adjustment unit includes a support unit which is coupled to the inside of the support frame; and a height adjustment bolt screwed to the support unit and rotated by a tool to lift or lower the lifting and lowering frame, such that the lifting and lowering frame is horizontally adjustable and thus has increased constructability.

10 Claims, 10 Drawing Sheets

(56) References Cited

U.S. PATENT DOCUMENTS

| | | | | |
|---|---|---|---|---|
| 6,889,477 | B1 * | 5/2005 | Kottman | E04B 2/7422 52/64 |
| 9,617,732 | B2 * | 4/2017 | Kopish | H02G 3/288 |
| 2010/0242378 | A1 * | 9/2010 | Cifelli | E04B 2/821 52/126.6 |

FOREIGN PATENT DOCUMENTS

| | | | |
|---|---|---|---|
| CN | 201835406 | U | 5/2011 |
| CN | 202214854 | U | 5/2012 |
| CN | 103228852 | A | 7/2013 |
| CN | 108487052 | A | 9/2018 |
| CN | 206495370 | U | 9/2019 |
| JP | 2001-207576 | A | 8/2001 |
| JP | 2005023610 | A | 1/2005 |
| KR | 20-0172604 | Y1 | 3/2000 |
| KR | 10-0941607 | B1 | 2/2010 |
| KR | 20-0456489 | Y1 | 11/2011 |
| KR | 10-1452967 | B1 | 10/2014 |
| KR | 10-1498832 | B1 | 3/2015 |
| KR | 10-1863507 | B1 | 6/2018 |

* cited by examiner

WALL SYSTEM WITH HEIGHT ADJUSTMENT UNIT

BACKGROUND OF THE DISCLOSURE

Field of the Disclosure

The present disclosure relates to a wall system with a height adjustment unit, and more particularly, to a wall system with a height adjustment unit, which includes a support frame installed on a floor surface, a lifting and lowering frame coupled to the support frame so as to be able to move up and down along the outer surface of the support frame while surrounding the support frame, and a height adjustment unit installed between the support frame and the lifting and lowering frame to lift or lower the lifting and lowering frame, thus allowing the lifting and lowering frame to be horizontally adjusted and thereby enabling the wall to be easily installed on an upper side of the lifting and lowering frame, and in which the wall is fixed using a gasket that is coupled while coupling protrusions engage with locking steps formed on inner surfaces of both sides in a width direction of each of a fixed frame and a wall-lower-end receiving part of the lifting and lowering frame, thus making it easy to disassemble and reassemble the wall system.

Related Art

Generally, the internal space of various buildings is partitioned by a fixed wall or a prefabricated wall. Recently, a prefabricated-wall construction in which a plurality of boards is manufactured and assembled instead of several processes is being increased. However, a conventional prefabricated wall focuses only on the assembly of materials and neglects the disassembly, so it is difficult to reinstall a wall once it is constructed and to reuse the materials.

The conventional prefabricated wall is constructed using many members such as a stud, a runner, a molding, a fixing member, or a finishing member, so a lot of construction manpower is required. Moreover, it is impossible to change the wall depending on the environment of a construction site, and the wall should be customized depending on electrical wiring, cooling facilities, and the like. Further, this has drawbacks in that construction work is complicated and a construction period is long, so the maintenance of the prefabricated wall is not easy.

After forming a sphere with concrete, the floor surface of a building is finished in various ways such as plastering, tiles, and access floors. However, since there is a construction error in each process, it is difficult to actually achieve perfect leveling. Therefore, if a partition wall requiring verticality is constructed on the basis of a floor, the wall may not be set vertically. In this case, a height adjustment device capable of adjusting the level of a wall or a frame supporting the wall is required. In particular, in the case of a heavy wall such as a glass wall, the height adjustment device is further required.

As an example of a height adjustable wall, the following patent document 1 has proposed a 'wall with a height adjustment device', and the following patent document 2 has proposed a 'height adjustable clean room wall'.

(Patent document 1) Korean Patent Publication No. 10-0941607 (Publication date: Feb. 11, 2010)

(Patent document 2) Korean U.M. Publication No. 20-0456489 (Publication date: Nov. 2, 2011)

SUMMARY

Patent document 1 has proposed a wall with a height adjustment device that can conveniently and reliably adjust the height of the wall for partitioning an indoor space in various ways, and can finely adjust the leveling of the wall installed on an uneven floor. However, this is problematic in that a lifting member is lifted up and down from a top of a support member by a height adjustment member operated by using a gear and operating a handle, thus adjusting the height of the wall, so this is not suitable for the wall of a building and a mechanical device is complicated, thereby causing a failure.

Patent document 2 has proposed a height adjustable clean room wall configured such that a height adjustment member is provided between a support member and a lifting and lowering member to lift and lower the lifting and lowering member and thereby adjust the height of the wall. Thus, the height of the wall may be adjusted according to the height of the interior of a building when constructing the clean room installed in a semiconductor factory, a hospital, a research institute, a pharmaceutical factory, etc., so the constructability of the clean room can be improved. Further, in the case of the wall that has already been installed, it is easy to maintain and repair the wall later, thus reducing management costs. However, in the case of using a wall that is relatively thin and heavy like a glass wall, the clean room wall of patent document 2 may not be stably fixed.

In order to solve the problems, the present disclosure provides a wall system with a height adjustment unit, which includes a support frame installed on a floor surface, a lifting and lowering frame coupled to the support frame so as to be able to move up and down along the outer surface of the support frame while surrounding the support frame, and a height adjustment unit installed in a space between the support frame and the lifting and lowering frame to lift or lower the lifting and lowering frame, thus allowing the lifting and lowering frame to be horizontally adjusted and thereby enhancing constructability.

Further, the present disclosure is to provide a wall system with a height adjustment unit, in which a wall is fixed using a gasket that is coupled while coupling protrusions engage with locking steps formed on inner surfaces of both sides in a width direction of each of a fixed frame and a wall-lower-end receiving part of a lifting and lowering frame, so that it is unnecessary to finish corners of the wall with silicone, thus making it easy to disassemble and reassemble the wall system.

Furthermore, the present disclosure is to provide a wall system with a height adjustment unit, in which a support frame, a lifting and lowering frame, a fixed frame, and a height adjustment unit have simple configurations, so it is easy to install, disassemble, and reassemble the wall system, and the support frame, the lifting and lowering frame, the fixed frame, the height adjustment unit, and a gasket may be recycled when the wall system is disassembled and reassembled, and the installed wall has a slim and good appearance.

According to various embodiments of the present disclosure, a wall system with a height adjustment unit includes a support frame installed on a floor surface; a lifting and lowering frame coupled to the support frame so as to be able to move up and down along an outer surface of the support frame while surrounding the support frame; a plurality of height adjustment units installed between the support frame and the lifting and lowering frame so as to lift or lower the lifting and lowering frame; a fixed frame installed on a ceiling facing the support frame; and a wall in which an upper end is disposed inside the fixed frame and a lower end is disposed and installed in a wall-lower-end receiving part of the lifting and lowering frame, and the height adjustment unit includes a support unit coupled to an inside of the support frame; and a height adjustment bolt screwed to the support unit and rotated by a tool to lift or lower the lifting and lowering frame.

Advantageous Effects

As described above, a wall system with a height adjustment unit includes a support frame installed on a floor surface, a lifting and lowering frame coupled to the support frame so as to be able to move up and down along the outer surface of the support frame while surrounding the support frame, and a height adjustment unit installed between the support frame and the lifting and lowering frame to lift or lower the lifting and lowering frame, thus allowing the lifting and lowering frame to be horizontally adjusted and thereby enhancing constructability.

Furthermore, a wall system with a height adjustment unit is advantageous in that a wall is fixed using a gasket that is coupled while coupling protrusions engage with locking steps formed on inner surfaces of both sides in a width direction of each of a fixed frame and a wall-lower-end receiving part of a lifting and lowering frame, so that it is unnecessary to finish corners of the wall with silicone, thus making it easy to disassemble and reassemble the wall system.

In addition, a wall system with a height adjustment unit is advantageous in that a support frame, a lifting and lowering frame, a fixed frame, and a height adjustment unit have simple configurations, so it is easy to install, disassemble, and reassemble the wall system, and the support frame, the lifting and lowering frame, the fixed frame, the height adjustment unit, and a gasket may be recycled when the wall system is disassembled and reassembled, and the installed wall has a slim and good appearance.

DESCRIPTION OF EXEMPLARY EMBODIMENTS

Figure 1:
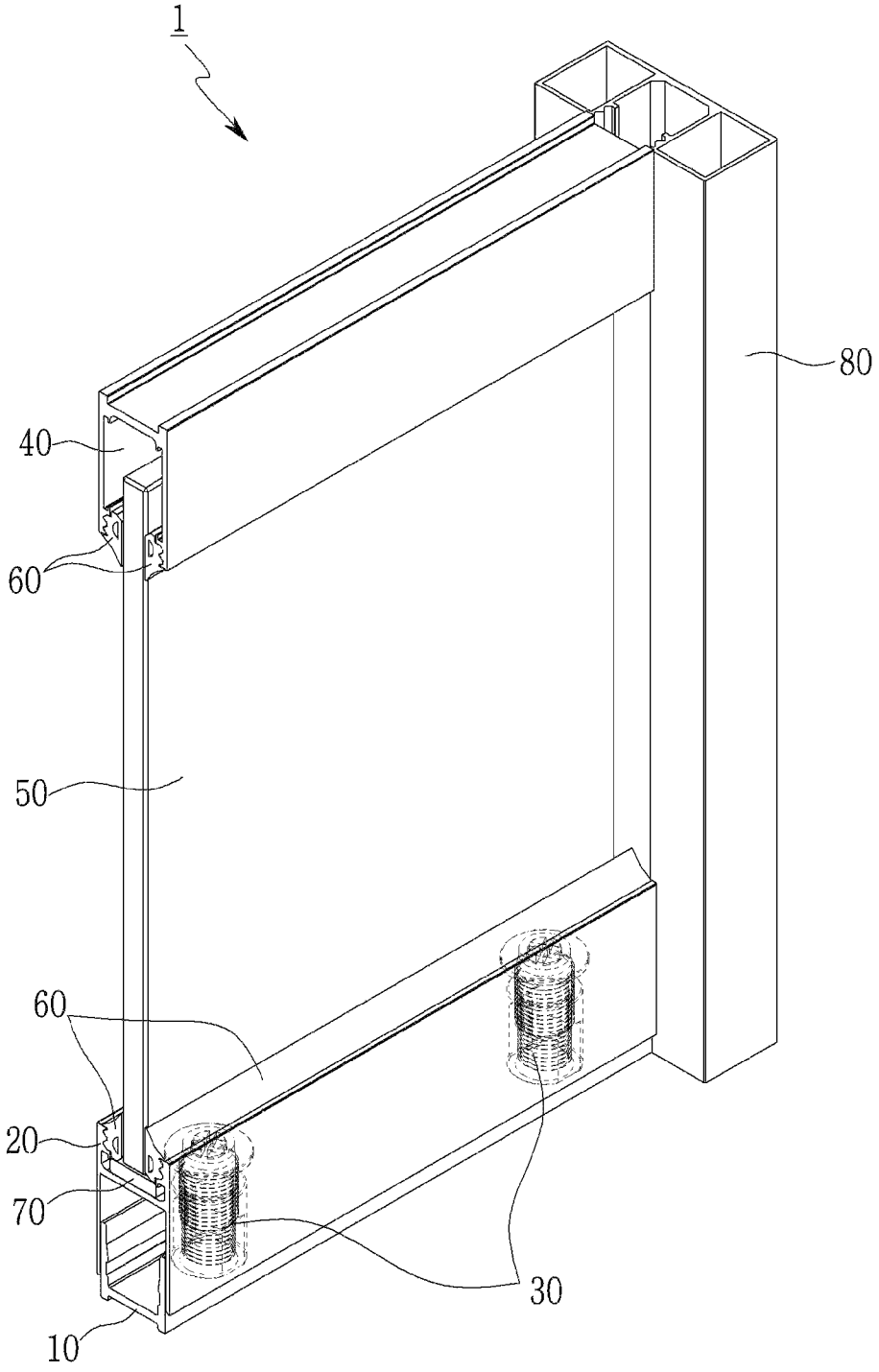
FIG. 1 is a perspective view illustrating an overall configuration of a wall system according to an embodiment of the present disclosure.

According to an aspect of the present disclosure, a wall system with a height adjustment unit includes a support frame installed on a floor surface; a lifting and lowering frame coupled to the support frame so as to be able to move up and down along an outer surface of the support frame while surrounding the support frame; a plurality of height adjustment units installed between the support frame and the lifting and lowering frame so as to lift or lower the lifting and lowering frame; a fixed frame installed on a ceiling facing the support frame; and a wall in which an upper end is disposed inside the fixed frame and a lower end is disposed and installed in a wall-lower-end receiving part of the lifting and lowering frame, and the height adjustment unit includes a support unit coupled to an inside of the support frame; and a height adjustment bolt screwed to the support unit and rotated by a tool to lift or lower the lifting and lowering frame.

Hereinafter, preferred embodiments of the present disclosure will be described in detail with reference to the accompanying drawings. However, the present disclosure may be embodied in many different forms without being limited to embodiments set forth herein. Rather, the embodiments are provided to make the disclosure thorough and complete and to sufficiently convey the spirit of the present disclosure to those skilled in the art.

The terminology used herein is for the purpose of describing the embodiments and is not intended to limit the present disclosure. Herein, the singular forms are intended to include the plural forms as well, unless the context clearly indicates otherwise. It will be further understood that the terms "comprise" and/or "comprising" when used in this specification specify the presence of stated components, steps, operations, and/or elements but do not preclude the presence or addition of one or more other components, steps, operations, and/or elements.

As used herein, the terms "embodiment", "example", "aspect", "illustration", or the like are not intended to mean that any described aspect or design is better or more advantageous than other aspects or designs.

Further, the term "or" means "inclusive or" rather than "exclusive or". That is, the expression "x uses a or b" means any one of natural inclusive permutations, unless stated otherwise or unless the context explicitly indicates.

Furthermore, the singular expression "a" or "an" used in the specification and claims is generally to be construed as meaning "one or more", unless stated otherwise or unless the context explicitly indicates.

Further, it will be understood that, although the terms "first", "second", etc. may be used herein to describe various components, these components should not be limited by these terms. These terms are only used to distinguish one component from another component.

Unless otherwise defined, all terms including technical and scientific terms used herein have the same meaning as commonly understood by one of ordinary skill in the art to which the present disclosure pertains. It will be further understood that terms used herein will not be interpreted in an idealized or overly formal sense unless expressly so defined herein.

When it is determined that the detailed description of the known art related to the present disclosure may obscure the gist of the present disclosure, the detailed description will be omitted. In the description of the present disclosure, terminologies are defined in consideration of the functions of components of the present disclosure. Since the terms can be differently defined according to the intention of a user or an operator or customs, these terms should be interpreted as having a meaning that is consistent with the technical spirit of the present disclosure.

Hereinafter, the configuration of a wall system with a height adjustment unit according to an embodiment of the present disclosure will be described.

Figure 2:
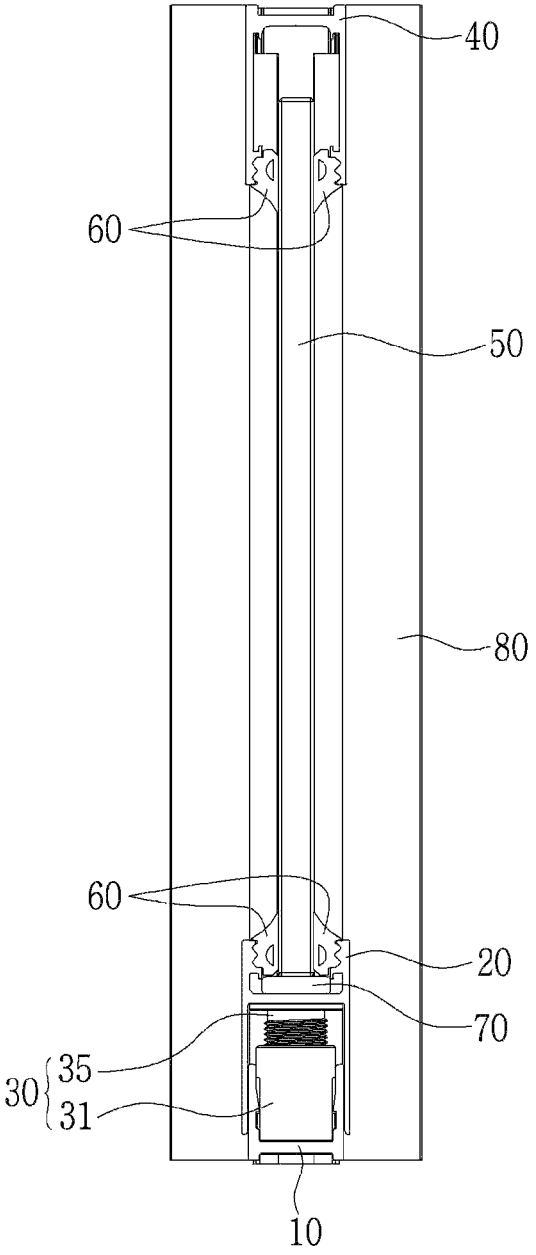
FIG. 2 is a side view of the wall system of FIG. 1.
Figure 3:
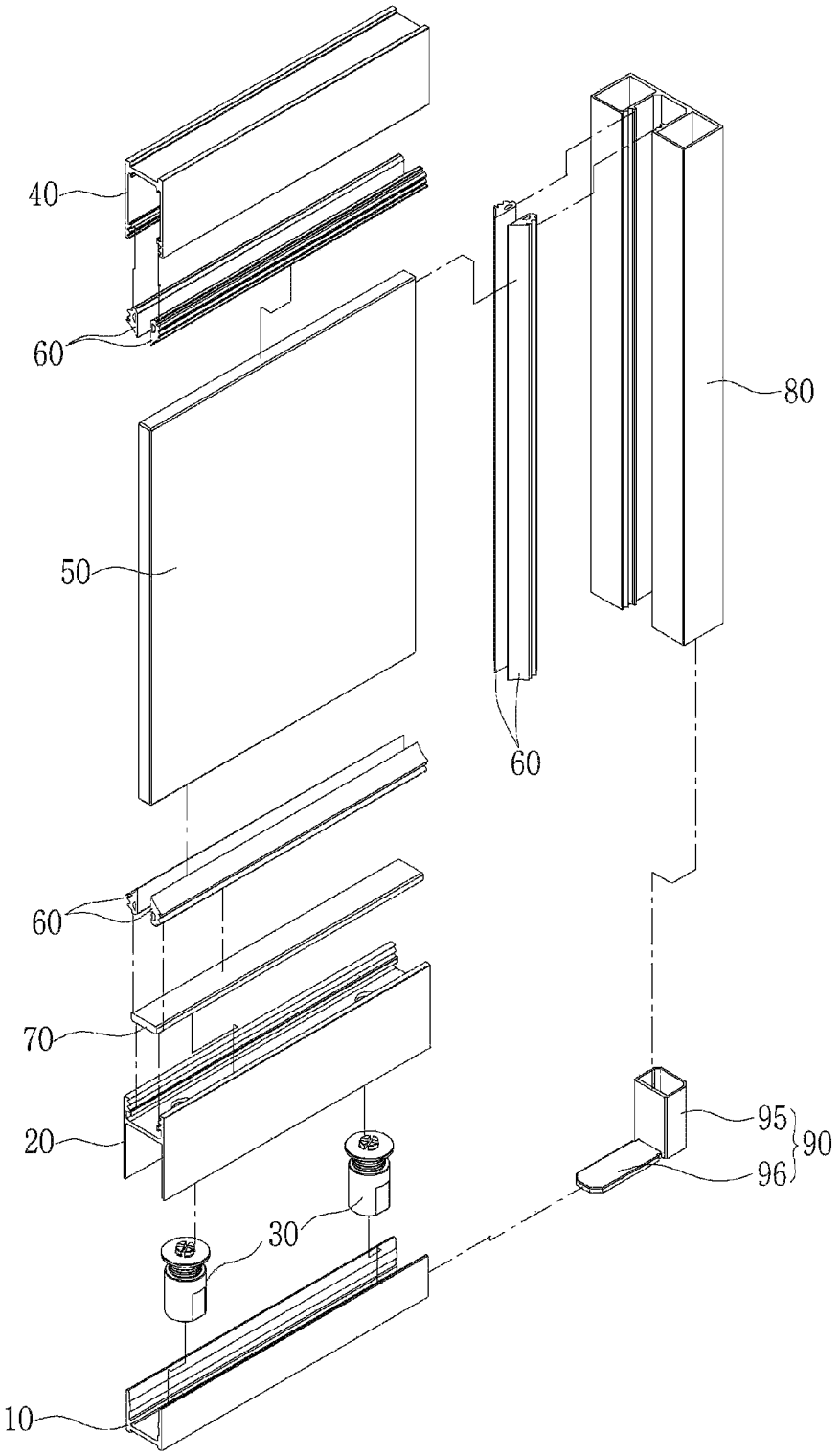
FIG. 3 is an exploded perspective view of the wall system of FIG. 1.
Figure 4:
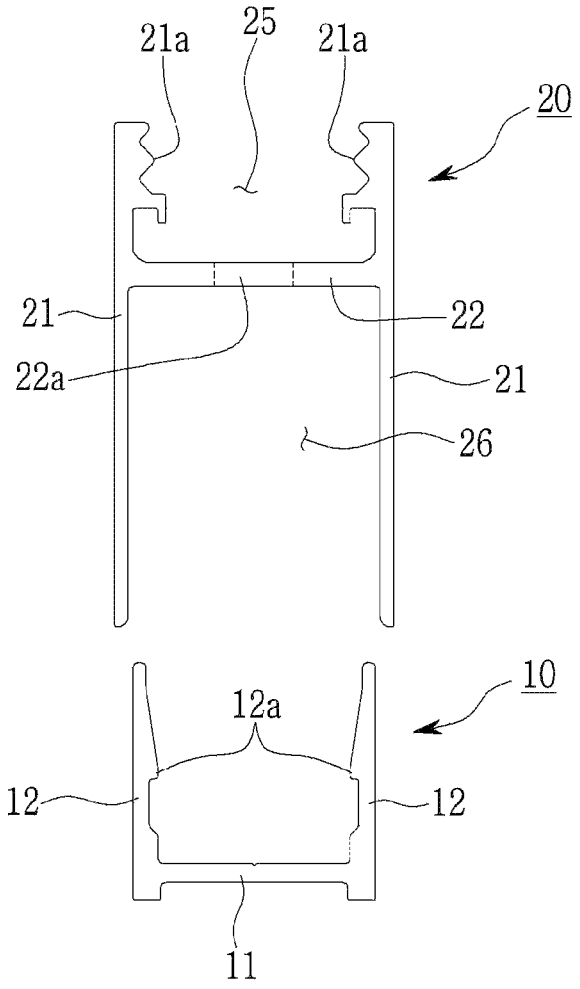
FIG. 4 is a sectional view illustrating a support frame and a lifting and lowering frame.
Figure 5:
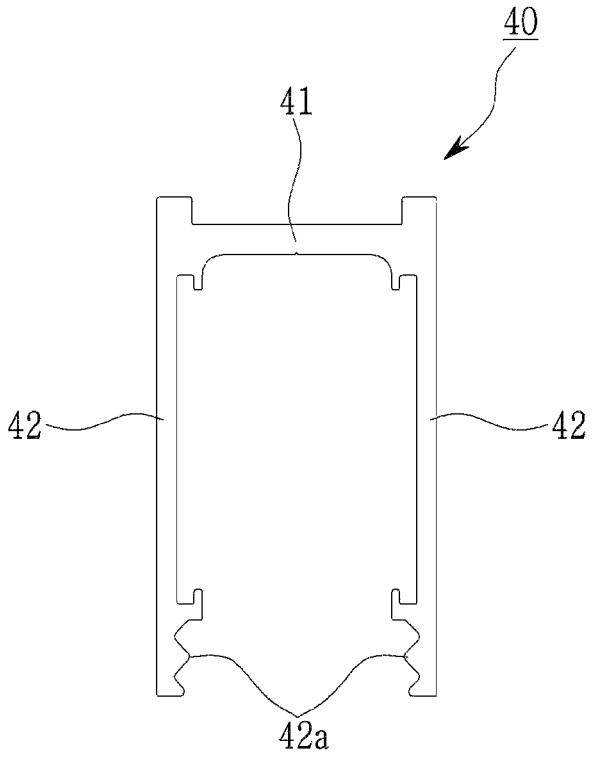
FIG. 5 is a sectional view illustrating a fixed frame installed on a ceiling.

FIG. 1 is a perspective view illustrating an overall configuration of a wall system according to an embodiment of the present disclosure, FIG. 2 is a side view of the wall system of FIG. 1, FIG. 3 is an exploded perspective view of the wall system of FIG. 1, FIG. 4 is a sectional view illustrating a support frame and a lifting and lowering frame, and FIG. 5 is a sectional view illustrating a fixed frame installed on a ceiling.

The wall system 1 according to the present disclosure includes a support frame 10 which is installed on a floor surface, a lifting and lowering frame 20, a plurality of height adjustment units 30 which are installed between the support frame 10 and the lifting and lowering frame 20, a fixed frame 40 which is installed on a ceiling facing the support frame 10, and a wall 50.

The support frame 10, the lifting and lowering frame 20, and the fixed frame 40 are structural components which support the wall system 1 according to the present disclosure.

The lifting and lowering frame 20 is coupled to the support frame 10 so as to be able to move up and down along the outer surface of the support frame 10 while surrounding the support frame 10 which is fixedly installed on the floor surface, and the plurality of height adjustment units 30 is installed between the support frame 10 and the lifting and lowering frame 20 so as to lift or lower the lifting and lowering frame 20.

The height adjustment unit 30 includes a support unit 31 which is coupled to an inside of the support frame 10, and a height adjustment bolt 35 which is screwed to the support unit 31. The height adjustment bolt 35 is installed to support the bottom of the lifting and lowering frame 20, and is rotated by a tool to lift or lower the lifting and lowering frame 20.

The plurality of height adjustment units 30 is provided between the support frame 10 and the lifting and lowering frame 20. Even when the floor surface of the building is not level, it is possible to level the lifting and lowering frame 20 using the plurality of height adjustment units 30, so constructability is enhanced.

The height adjustment unit 30 will be described later in detail.

The wall 50 is a flat panel member which forms most of a side part of the wall system 1 according to the present disclosure, and is configured such that an upper end is disposed inside the fixed frame 40 and a lower end is disposed and installed in a wall-lower-end receiving part 25 of the lifting and lowering frame 20.

Flat panels of various materials and sizes may be used as the wall 50, and may use panels such as an MDF panel, a foam board, or tempered glass. The outer surface of the wall 50 may be subjected to a wrapping process to wrap the wall in a film having various colors and patterns. In the case of the tempered glass, translucent figured glass with a pattern engraved on a surface thereof or wired sheet glass that contains a metal net therein and is pressed may be used.

Hereinafter, the support frame 10 will be described in detail.

The support frame 10 is a member which is fixedly installed on the floor surface of the building to support most of the vertical load of the wall system 1 according to the present disclosure, and includes a first base part 11 and a pair of first side parts 12.

The first base part 11 is a part which is fixedly installed to be adjacent to the floor surface when the support frame 10 is installed on the floor surface, and extends in a longitudinal direction to be parallel to the floor surface, and is formed to be sufficiently long with a certain width and fixed to the floor surface by a screw or the like.

According to various embodiments, as shown in FIG. 4, the pair of first side parts 12 may protrude perpendicularly from opposite ends of the first base part 11 in a width direction thereof to extend in the longitudinal direction.

The first base part 11 is fixedly installed to be adjacent to the floor surface. Thus, a portion of the first side part 12 protruding from each of the opposite ends of the first base part 11 in the width direction thereof to be away from the floor surface (upwards in a vertical direction) may be formed to a height sufficient to install the support unit 31 in the support frame 10. A portion of the first side part 12 protruding from each of the opposite ends of the first base part 11 in the width direction thereof towards the floor surface (downwards in the vertical direction) may be formed to a low height sufficient to create a small gap between the first base part 11 and the floor surface when the support frame 10 is installed on the floor surface.

However, the present disclosure is not necessarily limited thereto. The first side part 12 may be formed to protrude only in the direction (upwards in the vertical direction) from each of the opposite ends of the first base part 11 in the width direction thereof to be away from the floor surface. In this case, the first base part 11 is in close contact with the floor surface to be fixed thereto by a screw or the like.

Hereinafter, the lifting and lowering frame 20 will be described in detail.

The lifting and lowering frame 20 is a member which is coupled to the support frame 10 so as to be able to move up and down along the outer surface of the support frame 10 while surrounding the support frame 10, and includes both side plates 21 disposed to be parallel to each other in the vertical direction, and a partition plate 22.

The side plates 21 are parts which are disposed to be parallel to each other in the vertical direction to form the outer surface of the lifting and lowering frame 20 exposed to the outside. The side plates 21 are disposed with a width allowing the outer surfaces of the pair of the first side parts 12 of the support frame 10 to slide while contacting the inner surfaces of the side plates, and the partition plate 22 formed between the side plates 21 to be parallel to the floor surface partitions the interior into the wall-lower-end receiving part 25 on an upper side and a support-frame receiving part 26 on a lower side.

The side plates 21 are formed to have a length sufficient to accommodate the support frame 10 in the support frame receiving part 26 and accommodate the height adjustment unit 30 installed between the partition plate 22 and the interior of the support frame 10.

The partition plate 22 is a member which extends between the side plates 21 to be parallel to the floor surface, thus partitioning the space between the side plates 21 into the wall-lower-end receiving part 25 on the upper side and the support-frame receiving part 26 on the lower side. When the lower end of the wall 50 is disposed and installed in the wall-lower-end receiving part 25, the lower end of the wall 50 is supported via a support rubber 70 which will be described below.

Hereinafter, the fixed frame 40 will be described in detail.

The fixed frame 40 is a member which is fixedly installed on the ceiling of the building facing the support frame 10 to fix the upper end of the wall 50 disposed therein, and includes a second base part 41 and a pair of second side parts 42.

The second base part 41 is a part which is installed to be adjacent to the ceiling when the fixed frame 40 is installed on the ceiling, and extends in the longitudinal direction to be parallel to the ceiling. The second base part is formed to be sufficiently long with a certain width and fixed to the ceiling by a screw or the like.

According to various embodiments, as shown in FIG. 5, a pair of second side parts 42 may protrude perpendicularly from the opposite ends of the second base part 41 in the width direction thereof to extend in the longitudinal direction.

The second base part 41 is fixedly installed to be adjacent to the ceiling. A portion of the second side part 42 protruding from each of the opposite ends of the second base part 41 in the width direction thereof to be away from the ceiling (downwards in the vertical direction) may be formed to a height allowing the upper end of the wall 50 to be sufficiently inserted into the fixed frame 40 and then lowered and allowing the lower end of the wall 50 to be seated in the wall-lower-end receiving part 25 when the wall 50 is installed between the lifting and lowering frame 20 and the fixed frame 40. A portion of the second side part 42 protruding from each of the opposite ends of the second base part 41 in the width direction thereof towards the ceiling (upwards in the vertical direction) may be formed to a low height sufficient to create a small gap between the second base part 41 and the ceiling when the fixed frame 40 is installed on the ceiling.

However, the present disclosure is not necessarily limited thereto. The second side part 42 may be formed to protrude only in the direction (downwards in the vertical direction) from each of the opposite ends of the second base part 41 in the width direction thereof to be away from the ceiling. In this case, the second base part 41 is in close contact with the ceiling to be fixed thereto by a screw or the like.

The support frame 10, the lifting and lowering frame 20, and the fixed frame 40 may be made of various materials. However, they are preferably made of aluminum or aluminum alloy, which has good workability and is light in weight.

Figure 6:
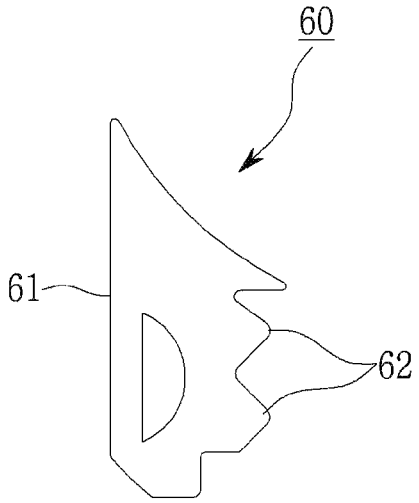
FIG. 6 is a sectional view of a gasket.

The wall system 1 according to the present disclosure may further include a plurality of gaskets 60. FIG. 6 is a sectional view of the gasket.

The gasket 60 is a member which is generally similar to silicone closing a corner portion between a chassis and the wall when seeing the installed wall system 1 according to the present disclosure from the outside. The gasket is made of an elastic material, i.e., an elastic material such as rubber or an elastic synthetic material. A contact part 61 which is in close contact with the wall 50 is formed on one side in a width direction to extend in a longitudinal direction, while one or more coupling protrusions 62 are formed on the other side in the width direction to extend in the longitudinal direction.

In order to allow the plurality of gaskets 60 to be coupled, one or more locking steps 21*a* and 42*a* are formed on inner surfaces of both sides in a width direction of each of the fixed frame 40 and the wall-lower-end receiving part 25 of the lifting and lowering frame 20 to extend in the longitudinal direction That is, as shown in FIGS. 4 and 5, one or more locking steps 21*a* are formed on the inner surfaces of the upper sides of the pair of side plates 21, which are the inner surfaces of both sides in the width direction of the wall-lower-end receiving part 25, to extend in the longitudinal direction, and one or more locking steps 42*a* are formed on the inner surfaces of the lower sides of the pair of second side parts 42, which are the inner surfaces of both sides in the width direction of the fixed frame 40, to extend in the longitudinal direction.

In the case of installing the wall 50 between the lifting and lowering frame 20 and the fixed frame 40 using the plurality of gaskets 60, first, the plurality of gaskets 60 are pushed in the longitudinal direction to be coupled to the inner surfaces of both sides in the width direction of each of the fixed frame 40 and the wall-lower-end receiving part 25 such that the coupling protrusions 62 engage with the locking steps 21*a* and 42*a*.

In a state where the plurality of gaskets 60 are coupled to the inner surfaces of both sides in the width direction of each of the fixed frame 40 and the wall-lower-end receiving part 25, the wall 50 is disposed such that the upper end is inserted between a pair of gaskets 60 coupled to the inner surfaces of both sides in the width direction of the wall-lower-end receiving part 25, and the lower end is inserted between another pair of gaskets 60 coupled to the inner surfaces of both sides in the width direction of the fixed frame 40. Thereby, the wall is installed between the lifting and lowering frame 20 and the fixed frame 40.

Since the wall 50 is fixed using the plurality of gaskets 60, it is unnecessary to finish corners of the wall with silicone, thus making it easy to disassemble and reassemble the wall system 1.

The wall system 1 according to the present disclosure may further include a support rubber 70.

The support rubber 70 is a member which is placed on the partition plate 22 when the lower end of the wall 50 is disposed and installed in the wall-lower-end receiving part 25, and functions to transfer the load of the wall 50 to the partition plate 22 while supporting the lower end of the wall 50. The support rubber prevents the lower end of the wall 50 from being broken due to concentration of load or friction with the partition plate 22, and prevents the head adjustment bolt 35 from being unintentionally rotated when it comes into close contact with a projecting part 351*a* of the height adjustment bolt 35 exposed through a tool insert hole 22*a* formed in the partition plate 22, thus preventing the height of the lifting and lowering frame 20 from being arbitrarily changed after the wall system 1 according to the present disclosure is installed.

Such a support rubber 70 may be formed and used as a single member which is formed sufficiently long with a certain width, or a plurality of support rubbers 70 each having a proper length may be disposed and used on the partition plate 22.

The wall system 1 according to the present disclosure may further include a vertical frame 80.

Figure 7:
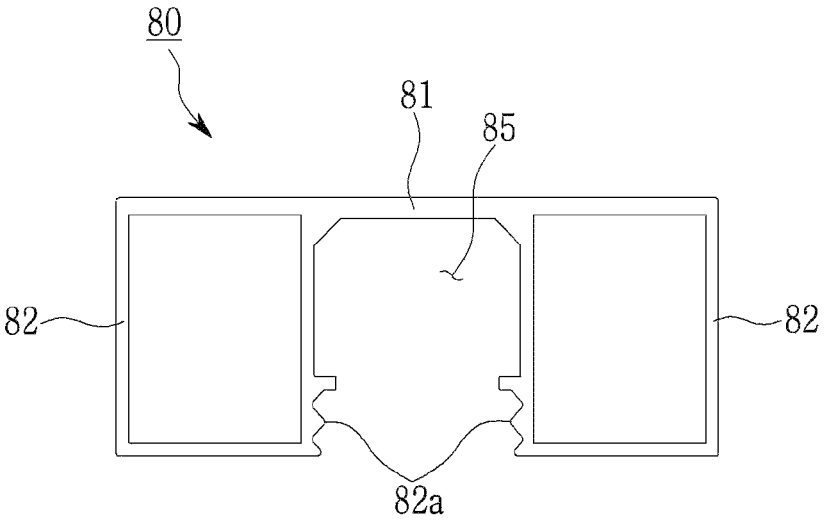
FIG. 7 is a sectional view illustrating a vertical frame installed on a sidewall of a building.

FIG. 7 is a sectional view illustrating a vertical frame installed on a sidewall of a building.

The vertical frame 80 is a member which is fixedly installed on the sidewall of the building to fix the side end of the wall 50 disposed therein, and includes a third base part 81 and a pair of third side parts 82.

The third base part 81 is a part which is in close contact with the sidewall of the building to be fixed by a screw or the like, and is formed to be sufficiently long with a certain width.

According to various embodiments, as shown in FIG. 7, the pair of third side parts 82 may protrude perpendicularly from opposite ends of the third base part 81 in a width direction thereof to extend in a longitudinal direction.

Although FIG. 7 shows the third side part 82 in the shape of a hollow square beam different from that of the side plate 21 or the second side part 42, this is only one of the various embodiments. The third side part 82 may be formed in the shape of a flat square beam having a small width, unlike that of FIG. 7, or may be formed in the shape of a plate such as the side plate 21 or the second side part 42.

The vertical frame 80 may be made of various materials. However, it is preferably made of aluminum or aluminum alloy, which has good workability and is light in weight.

On the other hand, the vertical frame 80 may be configured to fix the side end of the wall 50 disposed therein via a pair of gaskets 60.

To this end, one or more locking steps 82*a* may be formed on the inner surfaces of both sides of the vertical frame 80 in a width direction to extend in a longitudinal direction.

That is, as shown in FIG. 7, one or more locking steps 82*a* may be formed on inner surfaces of the pair of third side parts 82 remote from the third base part 81, which are the inner surfaces of both sides of the vertical frame 80 in the width direction, to extend in the longitudinal direction.

In the case of fixing the side end of the wall 50 disposed therein via the pair of gaskets 60, first, the pair of gaskets 60 are pushed in the longitudinal direction to be coupled to the inner surfaces of both sides in the width direction of the vertical frame 80 such that the coupling protrusions 62 engage with the locking steps 82*a*.

In a state where the plurality of gaskets 60 are coupled to the inner surfaces of both sides in the width direction of each of the wall-lower-end receiving part 25, the fixed frame 40, and the vertical frame 80, the wall 50 is disposed such that the upper end is inserted between a pair of gaskets 60 coupled to the inner surfaces of both sides in the width direction of the wall-lower-end receiving part 25, the lower end is inserted between another pair of gaskets 60 coupled to the inner surfaces of both sides in the width direction of the fixed frame 40, and the side end is inserted between another pair of gaskets 60 coupled to the inner surfaces of both sides in the width direction of the vertical frame 80. Thereby, the wall is installed between the lifting and lowering frame 20, the fixed frame 40, and the vertical frame 80.

The wall system 1 according to the present disclosure may further include a connector 90, and the vertical frame 80 may be coupled to the support frame 10 via the connector 90.

The connector 90 is a member which couples one end of the support frame 10 and the lower end of the vertical frame 80 to prevent stress caused by the load of the wall system 1 according to the present disclosure from concentrating on a coupled portion and thereby reinforce a coupling strength between the support frame 10 and the vertical frame 80, and includes a vertical-frame coupling part 95 and a coupling piece 96.

In order to be coupled with the connector 90, a connector coupling part 85 is formed at a portion adjacent to the third base part 81 between the pair of third side parts 82 of the vertical frame 80.

Further, as shown in FIG. 3, the vertical-frame coupling part 95 may be formed in the shape of a hollow square beam to be inserted into and coupled to the connector coupling part 85.

However, the present disclosure is not necessarily limited thereto. The vertical-frame coupling part 95 may be formed in various shapes to be fixedly inserted into the connector coupling part 85.

The coupling piece 96 is a part that is inserted between the floor surface and the first base part 11 of the support frame 10, when the wall system 1 according to the present disclosure is installed, to fixedly couple the connector 90 to the support frame 10, and may be formed to protrude perpendicularly from one end of the vertical-frame coupling part 95 in the shape of a plate.

As described above, when the support frame 10 is installed on the floor surface, a small gap may be created between the first base part 11 and the floor surface. The coupling piece 96 is formed with a proper thickness and length to be fixedly inserted from one end of the support frame 10 fixedly installed on the floor surface into the gap created between the first base part 11 and the floor surface.

The connector 90 may be made of various materials. However, they are preferably made of aluminum or aluminum alloy, which has good workability and is light in weight.

Since one end of the support frame 10 and the lower end of the vertical frame 80 are coupled using such a connector 90, the wall system 1 according to the present disclosure may maintain a sufficient strength even during repeated installation, disassembly and reassembly.

Hereinafter, the height adjustment unit 30 will be described in detail.

Figure 8:
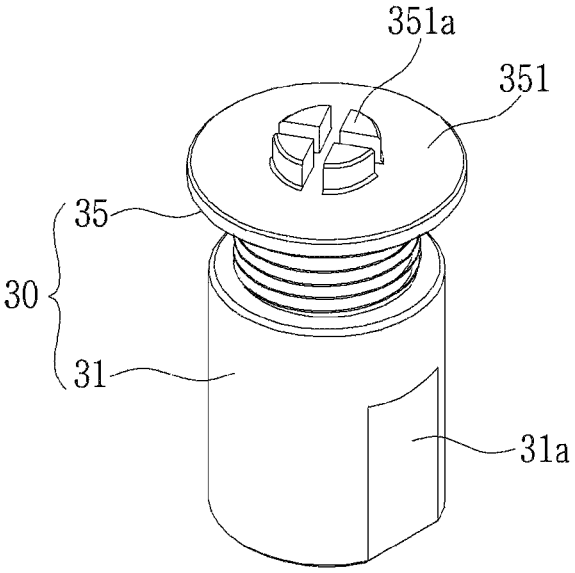
FIG. 8 is a perspective view of a height adjustment unit using a height adjustment bolt according to a first embodiment.
Figure 9:
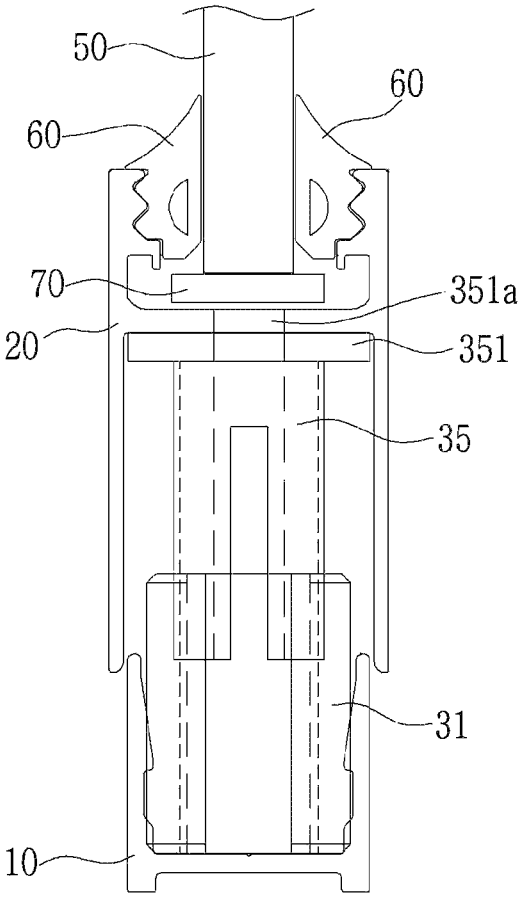
FIG. 9 is a sectional view illustrating the height adjustment unit of FIG. 8, a support frame, and a lifting and lowering frame.
Figure 10:
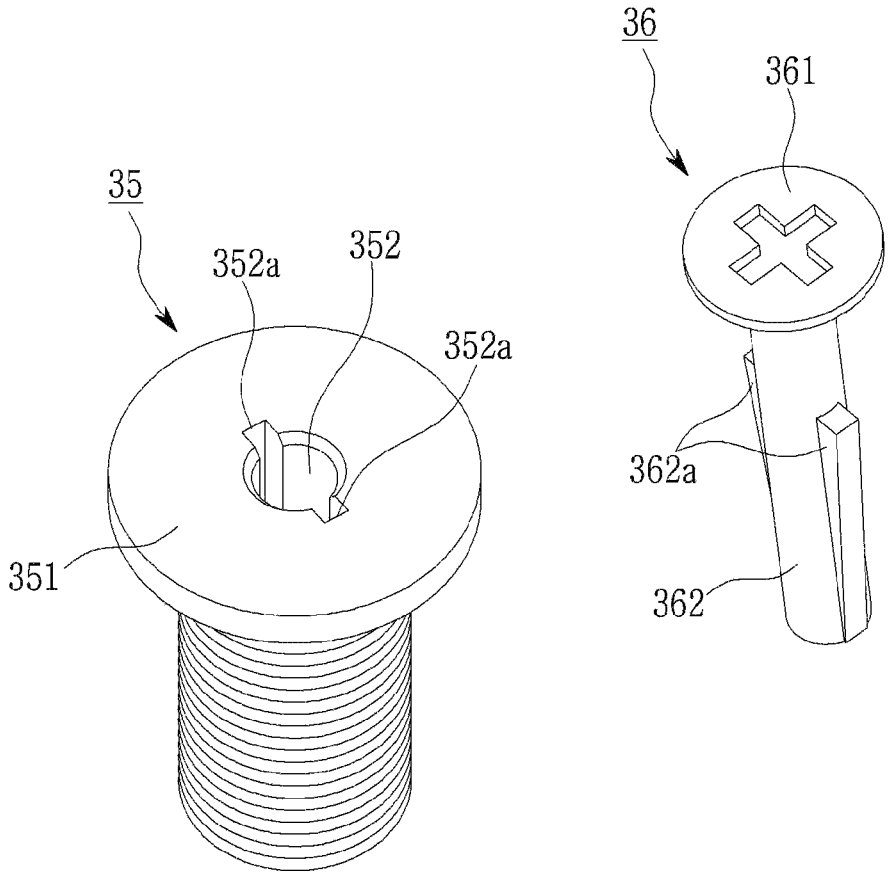
FIG. 10 is a perspective view illustrating a height adjustment bolt and a coupling member according to a second embodiment.
Figure 11:
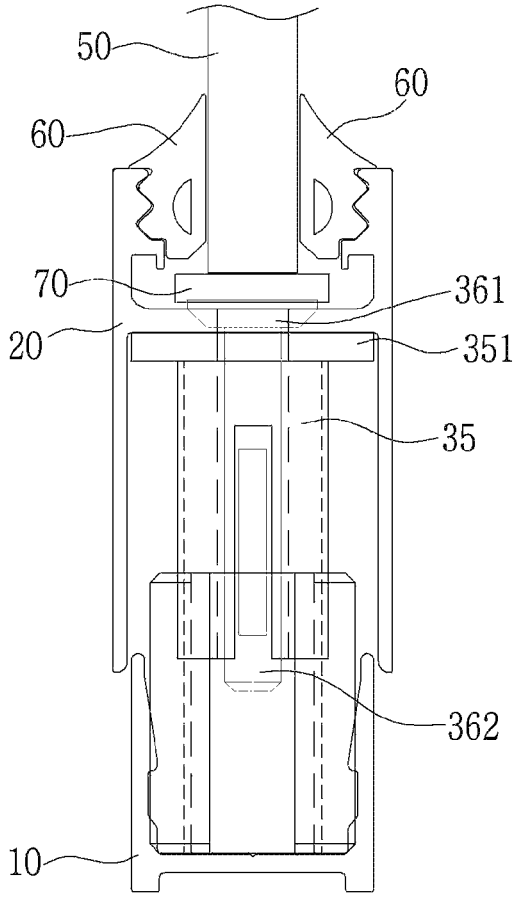
FIG. 11 is a sectional view illustrating the height adjustment unit of FIG. 10, a support frame, and a lifting and lowering frame.
Figure 12:
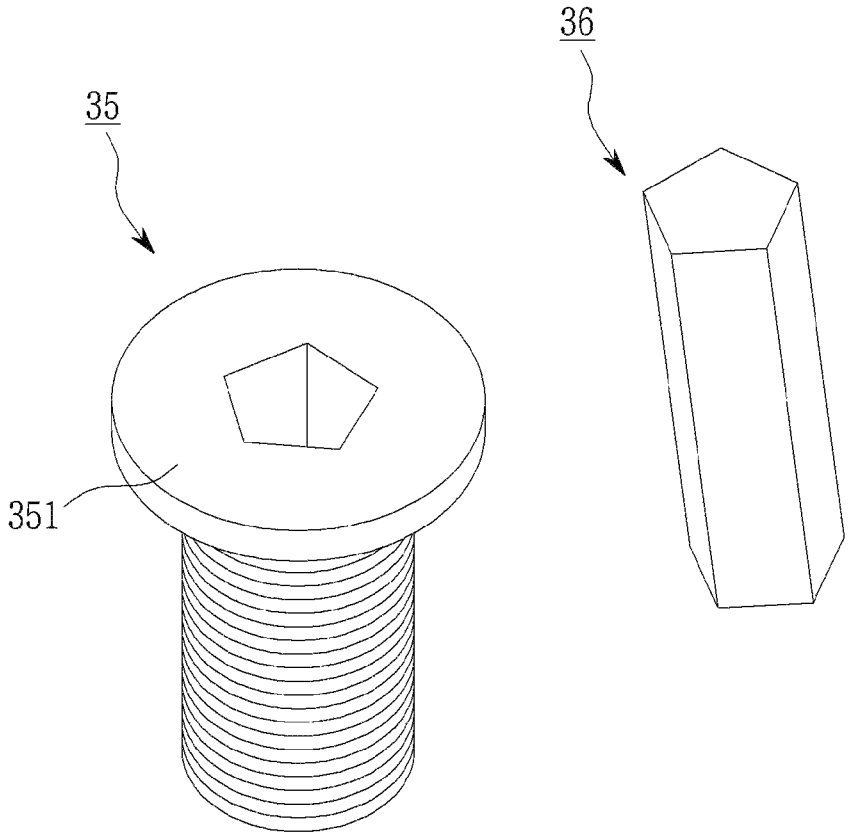
FIG. 12 is a perspective view illustrating a height adjustment bolt and a coupling member according to a third embodiment.

FIG. 8 is a perspective view of a height adjustment unit using a height adjustment bolt according to a first embodiment, FIG. 9 is a sectional view illustrating the height adjustment unit of FIG. 8, a support frame and a lifting and lowering frame, FIG. 10 is a perspective view illustrating a height adjustment bolt and a coupling member according to a second embodiment, FIG. 11 is a sectional view illustrating the height adjustment unit of FIG. 10, a support frame and a lifting and lowering frame, and FIG. 12 is a perspective view illustrating a height adjustment bolt and a coupling member according to a third embodiment.

As described above, the height adjustment unit 30 includes a support unit 31 which is coupled to an inside of the support frame 10, and a height adjustment bolt 35 which is screwed to the support unit 31.

The support unit 31 is a member which is coupled to an inside of the support frame 10, and functions to transfer the load of the wall 50 and the lifting and lowering frame 20 to the support frame 10 while supporting the load transferred through the height adjustment bolt 35. The support unit may not be integrally coupled to the support frame 10 by welding or the like, but may be merely coupled and installed to an inside of the support frame 10 so as not to be rotated leftward and rightward.

Such a support unit 31 may be formed to have a shape similar to a cylindrical pipe, a screw may be formed on the inner surface of an inner hole of the support unit 31 to be screwed to the height adjustment bolt 35, and support-frame locking grooves 31*a* may be formed on outer surfaces of both sides of the support unit 31 in a width direction thereof to prevent the support unit 31 from being rotated leftwards and rightwards.

However, the present disclosure is not necessarily limited thereto. Unlike the shape of FIG. 8, the support unit 31 may be formed in various shapes such as a square pillar.

In order to be stably coupled with the support unit 31, as shown in FIG. 4, support-unit locking steps 12*a* may be formed on the inner surfaces of the first side part 12, which are inner surfaces of both sides in the width direction of the support frame 10.

In this case, the support unit 31 is coupled and installed to an inside of the support frame 10 such that the support-unit locking step 12*a* engages with the support-frame locking groove 31*a*. Thereby, the support unit may be installed so as not to be rotated leftwards and rightwards even though the support unit is not integrally coupled to the support frame 10 by welding or the like.

The height adjustment bolt 35 is screwed to the support unit 31 to transmit the load of the wall 50 and the lifting and lowering frame 20 to the support unit 31 while supporting the bottom of the lifting and lowering frame 20, and is rotated by the tool to lift or lower the lifting and lowering frame 20, and includes a shaft having a screw on an outer surface thereof and a disc-shaped head 351.

The disc-shaped head 351 is a head part of the height adjustment bolt 35 in which a top portion contacts the bottom of the partition plate 22 to support the lifting and lowering frame 20, and is formed in the shape of a disc having a diameter that is almost equal to the width of the partition plate 22, unlike the shape of a ellipse, pan, dome, hexagon, or button that is the shape of a general bolt head to increase an area to which load is transmitted from the partition plate 22.

Although the head 351 is illustrated as having the disc shape, the present disclosure is not necessarily limited thereto. The head may be formed in the shape of a polygonal plate or dish, which is equivalent to the disc-shaped head 351 of the present disclosure. This may be interpreted to fall within the scope of the present disclosure.

Such a height adjustment bolt 35 is installed by screwing the shaft, which has the screw on the outer surface, to the screw formed in the inner surface of the inner hole of the support unit 31, and is rotated by the tool to lift or lower the lifting and lowering frame 20 while supporting the bottom of the partition plate 22.

According to the first embodiment of the present disclosure, a straight groove, a cross groove or a polygonal groove may be formed on the central portion of the top portion of the disc-shaped head 351.

Such a straight groove, cross groove, or polygonal groove allows a worker to rotate the height adjustment bolt 35 using a screwdriver or polygonal wrench and thereby lift or lower the lifting and lowering frame 20.

To this end, a plurality of tool insert holes 22*a* is formed in the partition plate 22 to rotate the height adjustment bolt 35.

The plurality of tool insert holes 22*a* may be formed at regular intervals in the longitudinal direction on a central portion in the width direction of the partition plate 22, and be formed to be positioned just above the height adjustment bolt 35 of the height adjustment unit 30 and thereby allow a tool such as a screwdriver or a polygonal wrench for rotating the height adjustment bolt 35 to be easily inserted, thus making it easy to adjust the height of the lifting and lowering frame 20 and level the frame and enhancing the constructability of the wall system 1 according to the present disclosure.

Further, as shown in FIG. 8, the height adjustment bolt 35 may further include the projecting part 351*a* formed on the central portion of the disc-shaped head 351.

In this case, a straight groove, a cross groove, or a polygonal groove may be formed on the central portion of the top surface of the projecting part 351*a*. Thus, the plurality of tool insert holes 22*a* may be formed in the partition plate 22 to rotate the height adjustment bolt 35.

If the height adjustment unit 30 is installed between the support frame 10 and the lifting and lowering frame 20, as shown in FIG. 9, the projecting part 351*a* protrudes slightly upwards form the top surface of the partition plate 22 while passing through the tool insert hole 22*a*, so the projecting part is in close contact with the support rubber 70 placed on the partition plate 22.

That is, when a worker rotates the height adjustment bolt 35 with a tool such as a screwdriver or a polygonal wrench to level the lifting and lowering frame 20, places the support rubber 70 on the partition plate 22, and then installs the wall 50 such that the lower end of the wall 50 is supported thereon, the support rubber 70 is in close contact with the projecting part 351*a* by the load of the wall 50.

Therefore, the unintended rotation of the height adjustment bolt 35 is prevented, so it is possible to prevent the height of the lifting and lowering frame 20 from being arbitrarily changed after the wall system 1 according to the present disclosure is installed.

According to the second embodiment of the present disclosure, the height adjustment unit 30 may further include a coupling member 36.

The coupling member 36 is a member which is coupled to the height adjustment bolt 35 to rotate the height adjustment bolt 35, and includes a shaft 362 and a spline 362*a* formed on a side surface of the shaft 362.

In order to be coupled with the coupling member 36, the height adjustment bolt 35 may further include a shaft insert hole 352 formed in the central portion of the top portion of the disc-shaped head 351, and a spline groove 352*a* formed on the side surface of the shaft insert hole 352.

The shaft insert hole 352 is a hole which is formed in the shape of a cylinder or a polygonal pillar to insert the shaft 362 of the coupling member 36 therein, and is preferably formed to pass through the shaft of the height adjustment bolt 35.

Further, in order to rotate the height adjustment bolt 35 together with the coupling member 36 when the coupling member 36 is coupled to the height adjustment bolt 35, at least one spline groove 352*a* is formed on the side surface of the shaft insert hole 352.

The shaft 362 of the coupling member 36 is a part that is formed in the shape of a cylinder or a polygonal pillar to be inserted into and coupled to the shaft insert hole 352 of the height adjustment bolt 35, and at least one spline 362*a* is formed on the side surface of the shaft 362.

At least one spline 362*a* may be formed on the side surface of the shaft 362 so that the height adjustment bolt 35 rotates together with the coupling member 36 when the coupling member 36 is coupled to the height adjustment bolt 35. However, multiple teeth may be formed at regular intervals in the circumferential direction of the shaft 362.

On the other hand, a straight groove, a cross groove, or a polygonal groove may be formed on the top surface of the shaft 362 of the coupling member 36. Thus, a plurality of tool insert holes 22*a* may be formed in the partition plate 22 to rotate the height adjustment bolt 35.

When installing the wall system 1 according to the present disclosure, a worker couples the support unit 31 to an inside of the support frame 10, couples the coupling member 36 to the height adjustment bolt 35 through the tool insert hole 22*a* positioned just above the height adjustment bolt 35 screwed to the support unit 31, and rotates the coupling member 36 and the height adjustment bolt 35 using a tool such as a screwdriver or a polygonal wrench to lift or lower the lifting and lowering frame 20.

In this case, the upper end of the coupling member 36 protrudes upwards from the disc-shaped head 351 of the height adjustment bolt 35 and protrudes slightly upwards from the top surface of the partition plate 22 to be in close contact with the support rubber 70 which is placed on the partition plate 22.

That is, when a worker rotates the coupling member 36 and the height adjustment bolt 35 with a tool such as a screwdriver or a polygonal wrench to level the lifting and lowering frame 20, places the support rubber 70 on the partition plate 22, and then installs the wall 50 such that the lower end of the wall 50 is supported thereon, the support rubber 70 is in close contact with the upper end of the coupling member 36 by the load of the wall 50.

Therefore, the unintended rotation of the height adjustment bolt 35 is prevented, so it is possible to prevent the height of the lifting and lowering frame 20 from being arbitrarily changed after the wall system 1 according to the present disclosure is installed.

As shown in FIG. 10, the coupling member 36 may further include a coupling member head 361.

The coupling member head 361 is a part that is formed on one end of the shaft 362 in the shape of a dish or disc. When the coupling member head 361 is provided on the coupling member 36, a straight groove, a cross groove, or a polygonal groove may be formed on the top surface. Thus, a plurality of tool insert holes 22*a* may be formed in the partition plate 22 to rotate the height adjustment bolt 35.

When installing the wall system 1 according to the present disclosure, a worker couples the support unit 31 to an inside of the support frame 10, couples the coupling member 36 to the height adjustment bolt 35 through the tool insert hole 22*a* positioned just above the height adjustment bolt 35 screwed to the support unit 31, and rotates the coupling member 36 and the height adjustment bolt 35 using a tool such as a screwdriver or a polygonal wrench to lift or lower the lifting and lowering frame 20. At this time, the coupling member head 361 protrudes slightly upwards from the top surface of the partition plate 22 to come into close contact with the support rubber 70 placed on the partition plate 22 (see FIG. 11).

Therefore, the unintended rotation of the height adjustment bolt 35 is prevented, so it is possible to prevent the height of the lifting and lowering frame 20 from being arbitrarily changed after the wall system 1 according to the present disclosure is installed. When the coupling member head 361 is provided on the coupling member 36, a contact area between the coupling member head 361 and the support rubber 70 is increased and thereby the anti-rotation effect of the height adjustment bolt 35 is further increased.

According to the third embodiment of the present disclosure, as shown in FIG. 12, the height adjustment unit 30 may further include the coupling member 36 which is formed in the shape of a polygonal pillar.

The coupling member 36 is a member which is coupled to the height adjustment bolt 35 to rotate the height adjustment bolt 35, and a polygonal groove is formed in the central portion of the top portion of the disc-shaped head 351 of the height adjustment bolt 35 to be coupled with the coupling member 36.

When installing the wall system 1 according to the present disclosure, a worker couples the support unit 31 to an inside of the support frame 10, couples the coupling member 36 to the height adjustment bolt 35 through the tool insert hole 22*a* positioned just above the height adjustment bolt 35 screwed to the support unit 31, and rotates the coupling member 36 and the height adjustment bolt 35 using a tool such as a socket wrench to lift or lower the lifting and lowering frame 20.

In this case, the upper end of the coupling member 36 protrudes upwards from the disc-shaped head 351 of the height adjustment bolt 35 and protrudes slightly upwards from the top surface of the partition plate 22 to be in close contact with the support rubber 70 which is placed on the partition plate 22.

Therefore, the unintended rotation of the height adjustment bolt 35 is prevented, so it is possible to prevent the height of the lifting and lowering frame 20 from being arbitrarily changed after the wall system 1 according to the present disclosure is installed.

On the other hand, a straight groove, a cross groove, or a hexagonal groove may be formed on the top surface of the coupling member 36.

In this case, when installing the wall system 1 according to the present disclosure, a worker couples the support unit 31 to an inside of the support frame 10, couples the coupling member 36 to the height adjustment bolt 35 through the tool insert hole 22*a* positioned just above the height adjustment bolt 35 screwed to the support unit 31, and rotates the coupling member 36 and the height adjustment bolt 35 using a tool such as a socket wrench, a screwdriver, or a hexagonal wrench to lift or lower the lifting and lowering frame 20.

As described above, a wall system with a height adjustment unit includes a support frame installed on a floor surface, a lifting and lowering frame coupled to the support frame so as to be able to move up and down along the outer surface of the support frame while surrounding the support frame, and a height adjustment unit installed between the support frame and the lifting and lowering frame to lift or lower the lifting and lowering frame, thus allowing the lifting and lowering frame to be horizontally adjusted and thereby enhancing constructability.

Furthermore, the present disclosure provides a wall system with a height adjustment unit, in which a wall is fixed using a gasket that is coupled while coupling protrusions engage with locking steps formed on inner surfaces of both sides in a width direction of each of a fixed frame and a wall-lower-end receiving part of a lifting and lowering frame, so that it is unnecessary to finish corners of the wall with silicone, thus making it easy to disassemble and reassemble the wall system.

In addition, the present disclosure provides a wall system with a height adjustment unit, in which a support frame, a lifting and lowering frame, a fixed frame, and a height adjustment unit have a simple configuration, so it is easy to install, disassemble, and reassemble the wall system, and the support frame, the lifting and lowering frame, the fixed frame, the height adjustment unit, and a gasket may be recycled when the wall system is disassembled and reassembled, and the installed wall has a slim and good appearance.

Although the present invention has been described in terms of specific items such as detailed elements as well as the limited embodiments and the drawings, they are only provided to help more general understanding of the invention, and the present invention is not limited to the above embodiments. It will be appreciated by those skilled in the art to which the present invention pertains that various modifications and changes may be made from the above description.

[Detailed Description of Main Elements]

1: wall system
10: support frame
11: first base part
12: first side part
12a: support-unit locking step
20: lifting and lowering frame
21: side plate
21a: locking step
22: partition plate
22a: tool insert hole
25: wall-lower-end receiving part
26: support frame receiving part
30: height adjustment unit
31: support unit
31a: support-frame locking groove
35: height adjustment bolt
351: disc-shaped head
351a: projecting part
352: shaft insert hole
352a: spline groove
36: coupling member
361: coupling member head
362: shaft
362a: spline
40: fixed frame
41: second base part
42: second side part
42a: locking step
50: wall
60: gasket
61: contact part
62: coupling protrusion
70: support rubber
80: vertical frame
81: third base part
82: third side part
82a: locking step
85: connector coupling part
90: connector
95: vertical-frame coupling part
96: coupling piece

INDUSTRIAL AVAILABILITY

The present disclosure relates to a wall system with a height adjustment unit, which includes a support frame installed on a floor surface, a lifting and lowering frame coupled to the support frame so as to be able to move up and down along the outer surface of the support frame while surrounding the support frame, and a height adjustment unit installed between the support frame and the lifting and lowering frame to lift or lower the lifting and lowering frame, thus allowing the lifting and lowering frame to be horizontally adjusted and thereby enhancing constructability. Consequently, this can be used in the field of manufacturing a prefabricated wall.

What is claimed is:

1. A wall system with a height adjustment unit, the wall system comprising:

a support frame installed on a floor surface;

a lifting and lowering frame coupled to the support frame so as to be able to move up and down along an outer surface of the support frame while surrounding the support frame;

a plurality of height adjustment units installed between the support frame and the lifting and lowering frame so as to lift or lower the lifting and lowering frame;

a fixed frame installed on a ceiling facing the support frame; and a wall in which an upper end is disposed inside the fixed frame and a lower end is disposed and installed in a wall-lower-end receiving part of the lifting and lowering frame, wherein the height adjustment unit comprises:

a support unit coupled to an inside of the support frame; and a height adjustment bolt screwed to the support unit and rotated by a tool to lift or lower the lifting and lowering frame, wherein the support frame comprises:

a first base part extending in a longitudinal direction to be parallel to the floor surface so as to be adjacent to the floor surface; and a pair of first side parts protruding perpendicularly from opposite ends of the first base part in a width direction thereof to extend in the longitudinal direction, wherein the lifting and lowering frame comprises a partition plate formed between a pair of side plates disposed in a vertical direction, the partition plate parallel to the floor surface and extend in the longitudinal direction, thus partitioning an interior into the wall-lower-end receiving part on an upper side and a support-frame receiving part on a lower side, wherein the fixed frame comprises:

a second base part extending in the longitudinal direction to be parallel to the ceiling so as to be adjacent to the ceiling; and a pair of second side parts protruding perpendicularly from opposite ends of the second base part in a width direction thereof to extend in the longitudinal direction, wherein the height adjustment unit further comprises a coupling member coupled to the height adjustment bolt to rotate the height adjustment bolt, wherein the height adjustment bolt comprises:

a disc-shaped head configured such that a top portion thereof contacts a lower portion of the partition plate to support the lifting and lowering frame;

a shaft insert hole formed in a central portion of the top portion; and a spline groove formed on a side surface of the shaft insert hole, wherein the coupling member comprises:

a shaft formed to be inserted into the shaft insert hole; and a spline formed on a side surface of the shaft, wherein a straight groove, a cross groove, or a polygonal groove is formed on a top surface of the shaft, and wherein a plurality of tool insert holes is formed in the partition plate to rotate the height adjustment bolt.

2. A wall system with a height adjustment unit, the wall system comprising:

a support frame installed on a floor surface;

a lifting and lowering frame coupled to the support frame so as to be able to move up and down along an outer surface of the support frame while surrounding the support frame;

a plurality of height adjustment units installed between the support frame and the lifting and lowering frame so as to lift or lower the lifting and lowering frame;

a fixed frame installed on a ceiling facing the support frame; and a wall in which an upper end is disposed inside the fixed frame and a lower end is disposed and installed in a wall-lower-end receiving part of the lifting and lowering frame, wherein the height adjustment unit comprises:

a support unit coupled to an inside of the support frame; and a height adjustment bolt screwed to the support unit and rotated by a tool to lift or lower the lifting and lowering frame, wherein the support frame comprises:

a first base part extending in a longitudinal direction to be parallel to the floor surface so as to be adjacent to the floor surface; and a pair of first side parts protruding perpendicularly from opposite ends of the first base part in a width direction thereof to extend in the longitudinal direction, wherein the lifting and lowering frame comprises a partition plate formed between a pair of side plates disposed in a vertical direction, the partition plate parallel to the floor surface and extend in the longitudinal direction, thus partitioning an interior into the wall-lower-end receiving part on an upper side and a support-frame receiving part on a lower side, wherein the fixed frame comprises:

a second base part extending in the longitudinal direction to be parallel to the ceiling so as to be adjacent to the ceiling; and a pair of second side parts protruding perpendicularly from opposite ends of the second base part in a width direction thereof to extend in the longitudinal direction, wherein the height adjustment unit further comprises a coupling member coupled to the height adjustment bolt to rotate the height adjustment bolt, wherein the height adjustment bolt comprises:

a disc-shaped head configured such that a top portion thereof contacts a lower portion of the partition plate to support the lifting and lowering frame;

a shaft insert hole formed in a central portion of the top portion; and a spline groove formed on a side surface of the shaft insert hole, wherein the coupling member comprises:

a shaft formed to be inserted into the shaft insert hole;

a spline formed on a side surface of the shaft; and a coupling member head formed on a first end of the shaft, wherein a straight groove, a cross groove, or a polygonal groove is formed on a top surface of the coupling member head, and wherein a plurality of tool insert holes is formed in the partition plate to rotate the height adjustment bolt.

3. A wall system with a height adjustment unit, the wall system comprising:

a support frame installed on a floor surface;

a lifting and lowering frame coupled to the support frame so as to be able to move up and down along an outer surface of the support frame while surrounding the support frame;

a plurality of height adjustment units installed between the support frame and the lifting and lowering frame so as to lift or lower the lifting and lowering frame;

a fixed frame installed on a ceiling facing the support frame; and a wall in which an upper end is disposed inside the fixed frame and a lower end is disposed and installed in a wall-lower-end receiving part of the lifting and lowering frame, wherein the height adjustment unit comprises:

a support unit coupled to an inside of the support frame; and a height adjustment bolt screwed to the support unit and rotated by a tool to lift or lower the lifting and lowering frame, wherein the support frame comprises:

a first base part extending in a longitudinal direction to be parallel to the floor surface so as to be adjacent to the floor surface; and a pair of first side parts protruding perpendicularly from opposite ends of the first base part in a width direction thereof to extend in the longitudinal direction, wherein the lifting and lowering frame comprises a partition plate formed between a pair of side plates disposed in a vertical direction, the partition plate parallel to the floor surface and extend in the longitudinal direction, thus partitioning an interior into the wall-lower-end receiving part on an upper side and a support-frame receiving part on a lower side, wherein the fixed frame comprises:

a second base part extending in the longitudinal direction to be parallel to the ceiling so as to be adjacent to the ceiling; and a pair of second side parts protruding perpendicularly from opposite ends of the second base part in a width direction thereof to extend in the longitudinal direction, wherein the height adjustment unit further comprises a coupling member coupled to the height adjustment bolt to rotate the height adjustment bolt, wherein the height adjustment bolt comprises a disc-shaped head configured such that a top portion thereof contacts a lower portion of the partition plate to support the lifting and lowering frame, and a polygonal groove is formed on a central portion of the top portion, and wherein the coupling member is formed in a shape of a polygonal pillar to be inserted into the polygonal groove.

4. The wall system of claim 3, wherein a straight groove, a cross groove, or a hexagonal groove is formed on the top surface of the coupling member.

5. The wall system of claim 1, wherein one or more locking steps are formed on inner surfaces of both sides in a width direction of each of the fixed frame and the wall-lower-end receiving part of the lifting and lowering frame to extend in the longitudinal direction, and the wall system further comprises:

a plurality of gaskets having a contact part which is formed on a first side in a width direction, is in close contact with the wall, and extends in a longitudinal direction, and one or more coupling protrusions which are formed on a second side in the width direction and extend in the longitudinal direction to engage with the one or more locking steps, and wherein the wall is installed such that the upper end is inserted between a pair of gaskets coupled while the one or more coupling protrusions engage with the one or more locking steps formed on the inner surfaces of both sides in the width direction of the fixed frame, and the lower end is inserted between another pair of gaskets coupled while the one or more coupling protrusions engage with the one or more locking steps formed on the inner surfaces of both sides in the width direction of the wall-lower-end receiving part of the lifting and lowering frame.

6. The wall system of claim 1, further comprising: a support rubber placed on the partition plate of the lifting and lowering frame to support the lower end of the wall.

7. The wall system of claim 1, further comprising:

a vertical frame installed on a sidewall of a building, wherein the vertical frame comprises:

a third base part which is in close contact with the sidewall of the building; and a pair of third side parts protruding perpendicularly from opposite ends of the third base part in a width direction thereof to extend in a longitudinal direction.

8. The wall system of claim 1, further comprising:

a vertical frame installed on a sidewall of a building, wherein one or more locking steps are formed on inner surfaces of both sides in the width direction of each of the wall-lower-end receiving part of the lifting and lowering frame, the fixed frame, and the vertical frame to extend in a longitudinal direction, wherein the wall system further comprises:

a plurality of gaskets having a contact part which is formed on a first side in a width direction, is in close contact with the wall, and extends in a longitudinal direction, and one or more coupling protrusions which are formed on a second side in the width direction and extend in the longitudinal direction to engage with the one or more locking steps, and wherein the wall is installed such that the upper end is inserted between a pair of gaskets coupled while the one or more coupling protrusions engage with the one or more locking steps formed on the inner surfaces of both sides in the width direction of the fixed frame, and the lower end is inserted between another pair of gaskets coupled while the one or more coupling protrusions engage with the one or more locking steps formed on the inner surfaces of both sides in the width direction of the wall-lower-end receiving part of the lifting and lowering frame, and a side end is inserted between another pair of gaskets coupled while the one or more coupling protrusions engage with the one or more locking steps formed on the inner surfaces of both sides in the width direction of the vertical frame.

9. The wall system of claim 7, further comprising:

a connector coupling the support frame and the vertical frame, a connector coupling part is formed at a portion adjacent to the third base part between the pair of third side parts of the vertical frame, and wherein the connector comprises:

a vertical-frame coupling part coupled to the connector coupling part; and a coupling piece protruding perpendicularly from a first end of the vertical-frame coupling part to be inserted between the floor surface and the first base part of the support frame.

10. The wall system of claim 1, wherein support-unit locking steps are formed on inner surfaces of both sides in a width direction of the support frame, support-frame locking grooves are formed on outer surfaces of both sides in the width direction of the support frame, and the support unit is coupled and installed to an inside of the support frame such that the support-unit locking steps engage with the support-frame locking grooves.

* * * * *